US006131545A

United States Patent [19]

Kreuter

[11] Patent Number: 6,131,545

[45] Date of Patent: Oct. 17, 2000

[54] APPARATUS FOR SWITCHING OFF A LOAD CHANGE VALVE OF AN INTERNAL COMBUSTION ENGINE

[75] Inventor: Peter Kreuter, Aachen, Germany

[73] Assignee: META Motoren-und Energie-Technik GmbH, Germany

[21] Appl. No.: 09/187,705

[22] Filed: Nov. 6, 1998

[30] Foreign Application Priority Data

Nov. 6, 1997 [DE] Germany ..... 197 49 124

[51] Int. Cl.[7] ..... F02B 77/00

[52] U.S. Cl. ..... 123/198 F; 123/90.16

[58] Field of Search ..... 123/90.16, 198 F

[56] References Cited

U.S. PATENT DOCUMENTS 4,387,680 6/1983 Tsunetomi et al. .
5,513,602 5/1996 Hannibal .

FOREIGN PATENT DOCUMENTS 4235626 4/1994 Germany .

*Primary Examiner*—Noah P. Kamen

*Attorney, Agent, or Firm*—Robert W. Becker & Associates

[57] ABSTRACT

An apparatus for switching off a load change valve of an internal combustion engine has a camshaft with a cam disk and a pivot lever pivotably connected to an engine part and pivoted back and forth by the cam disk. An actuator is moveably guided in the pivot lever for actuating the load change valve. A coupling member moveable in the pivot lever has two end positions defining a coupling and a decoupling position. In the coupling position the coupling member rigidly connects the actuator and the pivot lever. In the decoupling position the coupling member releases the actuator from the pivot lever to switch off the load change valve. A device for moving the coupling member into the coupling position and the decoupling position is provided. It has a coupling cam rotating at a same speed as the cam disk. It also has a coupling lever acting on the coupling member. The coupling cam acts on the coupling lever such that its cam projection moves the coupling member from one end position into the other end position and back into the one end position when the pivot lever follows a base contour of the cam disk. A catch device is arranged such that, when the catch device is activated, a portion of the coupling lever upon actuation by the coupling cam is secured by the catch device so that the coupling member remains in the other end position.

11 Claims, 7 Drawing Sheets

APPARATUS FOR SWITCHING OFF A LOAD CHANGE VALVE OF AN INTERNAL COMBUSTION ENGINE

BACKGROUND OF THE INVENTION

The present invention relates to an apparatus for switching off a load change valve of an internal combustion engine comprising a cam shaft with at least one cam disc and a pivot lever supported at the engine which is pivoted by the cam disc. An actuator is moveably guided within the pivot lever for actuating the valve. The coupling member is moveably guided within the pivot lever and has a coupling position and a decoupling position. In the coupling position it rigidly couples the actuator to the pivot lever and in the decoupling position it releases the actuator for movement relative to the pivot lever for switching off the valve. A device for moving the coupling member from the coupling position into the decoupling position and device versa is provided.

In the recent past, reduction of fuel consumption, especially for passenger cars, has been an important consideration for the respective internal engine design. One possibility for achieving this is a partial shutdown of individual cylinders so that the remaining cylinders during partial load operate at increased average pressure and thus have a reduced specific consumption. For shutting down the cylinders it is not only necessary to provide for an interruption of the fuel supply, it is furthermore expedient to interrupt the load flow through the respective cylinder by shutting down the one or more load change valves, especially the intake valve of the respective cylinder.

A device of the afore mentioned kind is known from German Patent application 196 27 390. For movement of the coupling components from the coupling position into the decoupling position a hydraulically operating actuating device is provided which moves upon its actuation the coupling component into the decoupling position by overcoming the force of a pretensioning device. One of multiple problems of this known device is that an exact phase-aligned actuation of the actuator is required because a movement of the coupling component from the coupling position into the decoupling position and vice versa is possible only when the valve is closed, respectively, the base contour of the cam of the cam shaft is effective.

From German Patent application 42 353 21 a valve drive with two alternatively actuatable cams for load change valves of internal combustion engines is known in which a valve has coordinated therewith a first cam for slightly opening the valve and a second cam for a wider degree of opening. A transmission element is coordinated with the first cam and is supported by a play compensation at the valve. A transmission lever supported at the cylinder head engages the second cam and is supported by a switchable follower device indirectly at the valve. The follower device is arranged between the transmission lever and the transmission element. A tappet is slidably and tangentially guided within the transmission lever and is supported at the valve by a play compensation device. The transmission lever can be coupled in a form-locking manner to the tappet by a switchable follower device arranged in the lever. When the tappet is either directly in contact with the first cam the follower device is inactive with a face thereof that is facing away from the valve or indirectly via the transmission lever. The follower device is embodied in the form of balls that can be moved into annular grooves at the tappet by slidable locking elements. The locking elements are hydraulically activated. This known valve drive also has the problem that the hydraulic actuation of the locking elements must be precisely phase-coordinated in order to prevent damage to the engine.

It is therefore an object of the present invention to improve a device of the aforementioned kind such that it is reliably ensured that switching off of the load change valve takes place especially when the base contour of the cam disc for actuation of valve is effective, i.e., when the pivot lever does not exert a force onto the actuator.

SUMMARY OF THE INVENTION

The apparatus of the present invention employs a device for moving the coupling member into the coupling position and into the decoupling position. The device has a coupling cam rotating at the same speed as the at least one cam disc and has a cam projection. The device also has a coupling lever acting on the coupling member. The coupling cam acts on the coupling lever such that the cam projection moves the coupling member from one of the end positions into the other end position and back into the one end position when the pivot lever follows the base contour of the cam disc. An activatable catch device is arranged such that, when the catch device is activated, a portion of the coupling lever upon actuation of the coupling cam is secured by the catch device so that the coupling member remains in the other end position.

With the coupling cam it is achieved that the coupling member is reliably moved from the coupling to the decoupling position or from the decoupling position into the coupling position when the valve is closed and the valve drive is relieved. The catch device independent of its activation, catches or secures the coupling lever that is moved by the coupling cam, in its end position so that an extremely secure switching off and switching on of the valve is achieved. For switching on or switching off the valve, the catch device then releases the coupling lever advantageously when the cam projection of the coupling cam is in the range of the coupling lever so that a safe switching, again for a closed valve, takes place with a well-defined movement of the coupling lever.

Whether the device is constructed such that the valve is actuated for a secured coupling lever or is inactive in this position depends on the desired application. When the normal state is the actuated state of the valve, the valve is advantageously not actuated when the coupling lever is secured and vice versa.

The catch device is preferably a solenoid having a catch area into which a portion of the coupling lever is moved by the cam projection of the coupling cam.

The solenoid is preferably U-shaped and the coupling lever is preferably moved into close proximity at the free pole surfaces of the legs of the U-shaped solenoid.

The catch device may comprise a moveable locking element that, upon activation of the catch device, is moved into a position in which it engages a portion of the coupling lever.

The catch device may be fixably connected to the engine so as to be coaxial with the support of the pivot lever.

The coupling cam is preferably connected to the cam shaft.

The coupling member is preferably a coupling shaft supported on the pivot lever and fixedly connected to the copuling lever. The coupling shaft has a cross section adapted for engagement of a cutout of the actuator.

A spring is provided which biases the coupling shaft in a rotational direction for abutment of the coupling lever at the coupling cam.

The coupling member may be embodied as a linearly guided tappet arranged in the pivot lever embodied for engagement of a cutout at the actuator.

The coupling lever may be a two-arm lever whereby in the end portion of one arm a follower surface for the coupling cam is provided and at the end portion of the other arm is embodied for engagement of the catch device.

The pivot lever may be a rocker arm. The coupling lever, supported with one end at the rocker arm and engaging with its other end the coupling cam, is provided in an area between its two ends with a portion for engagement by the catch device.

The inventive apparatus is suitable for all kinds of valve switch-off devices, for example, also in order to switch one of a plurality of intake valves in certain load conditions in order to provide especially favorable combustion conditions in the cylinder.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1–11.

Figure 1:
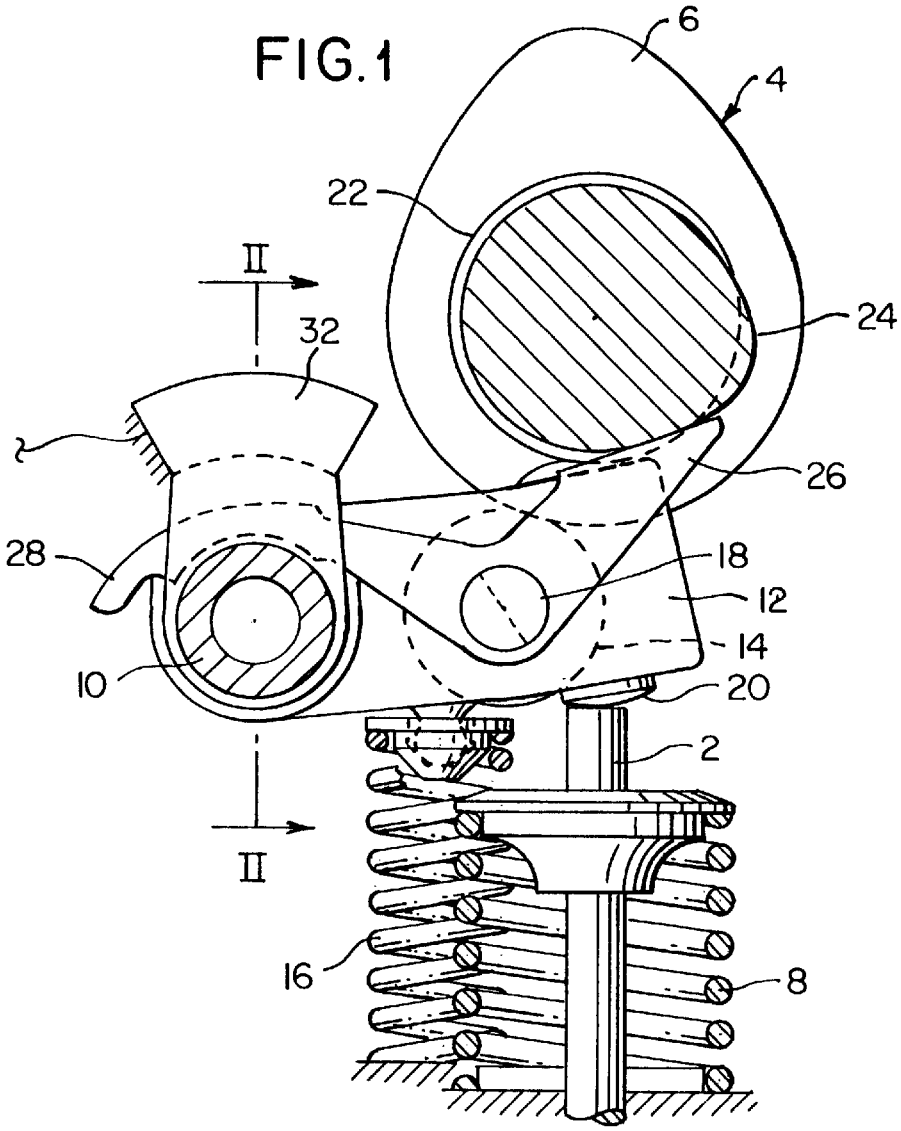
FIG. 1 shows an end view of the inventive apparatus, partly in section.
Figure 2:
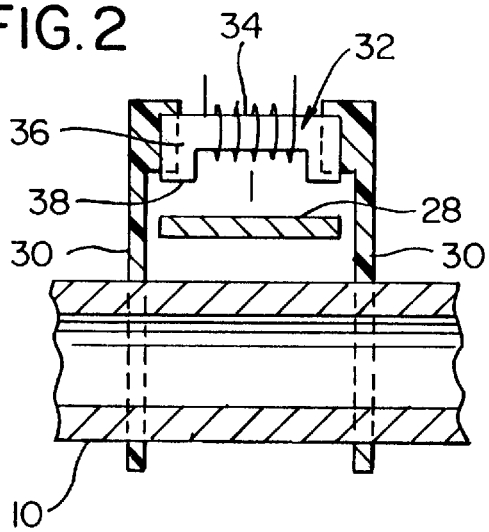
FIG. 2 shows a sectional view of the device of FIG. 1 taken along the plane II—II of FIG. 1.

According to FIG. 1, for actuating a load change valve 2 of a non-represented internal combustion engine, for example, an intake valve, a cam shaft 4 with a cam disk 6 is provided. The valve 2 is forced, as is known to a person skilled in the art, by a closure spring 8 into its closed position.

A pivot lever 1 is supported at a non-represented housing of the internal combustion engine by an axle or bushing 10, whereby a roller 14 is supported on the pivot lever 12 and is forced by a return spring 16 engaging the pivot lever 12 into abutment at the cam disc 6.

The roller 14 is supported at the pivot lever 12 by a coupling shaft 18 whose function will be explained in more detail with the aid of FIG. 4. An actuator 20 is moveably guided within the pivot lever 12. It is supported between the shaft of the valve 2 and a cylinder surface 22 of the camshaft 4. Advantageously, the actuator 20 is embodied as a valve play compensation element. The relative movement between the actuator 20 and the pivot lever 12 can be locked by the coupling shaft 18 in a manner which will be explained in the following.

A coupling cam 24 is provided at the camshaft 4 and actuates a coupling lever 26 which is coaxially arranged to the coupling shaft 18. In the shown embodiment, the coupling lever 26 is provided with two arms. The arm facing away from the coupling cam 24 ends in a portion 28 which is located directly above the bushing 10 for sensing and following the base contour of the coupling cam 24. The cam projection of the coupling cam 24 is located within an angular range in which the cylindrical base surface of the cam disc 6 is embodied, i.e., external to the cam projection of the cam disc 6.

At the bushing 10 (FIG. 2) a U-shaped solenoid 32 is arranged by means of securing arms 30. The solenoid has a coil 34 and its legs 36 end in the downward direction with end faces that are embodied as pole surfaces 38. The portion 28 of the coupling lever 26, when the coupling lever 26 is pivoted by the cam projection of the cam 24 in the clockwise direction, is moved directly into the proximity of the pole surfaces 38 so that, when the solenoid 32 is excited, it is attracted to the solenoid 32 and closes the magnetic flow. The portion 28 thus forms an anchoring portion. It is understood that at least the portion 28 of the coupling lever 26 is comprised of magnetically conducting material, for example, iron, and the securing arms 30 are comprised of plastic so that the function of the solenoid 32 is not impeded.

Figure 3:
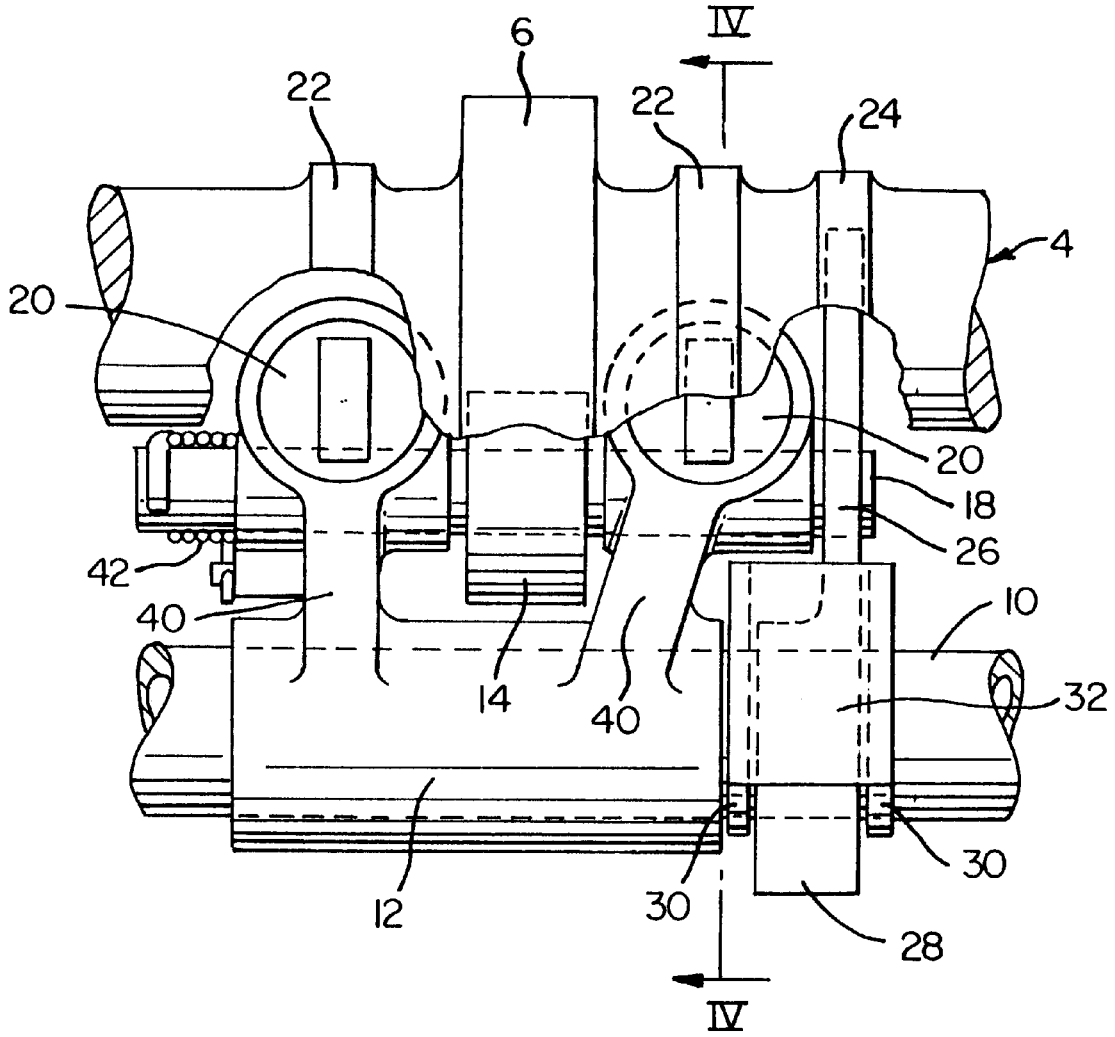
FIG. 3 shows a plan view of the device according to FIG. 1.

FIG. 3 shows the arrangement according to FIG. 1 in a plan view. It is shown that the pivot lever 12 has two upwardly extending arms 40 having ends in which a respective actuator 20 is moveably guided. The actuator 20 has in the upward direction a curved or spherical surface (see FIG. 4) that cooperates with the cylindrical surface 22 of the cam shaft 4. Thus, the pivot lever 12 can be used for actuating two valves, for example, two intake valves of a cylinder. The coupling shaft 18 is supported in the arms 40 and supports between the arms 40 the roller 14 for sensing or following the cam disc 6. Also shown is the coupling lever 26 which is fixedly or rigidly connected to the coupling shaft 18. Its portion 28 is positioned between the securing arms 30 of the solenoid 32.

In order to bias or prestress the coupling lever 26 connected to the coupling shaft 18 in a counter clockwise direction (according to FIG. 1) into abutment at the coupling cam 24, a torsion spring 42 is arranged at the end of the coupling shaft 18 facing away from the coupling lever 26 and is positioned between the coupling shaft 18 and the pivot lever 12.

Figure 4:
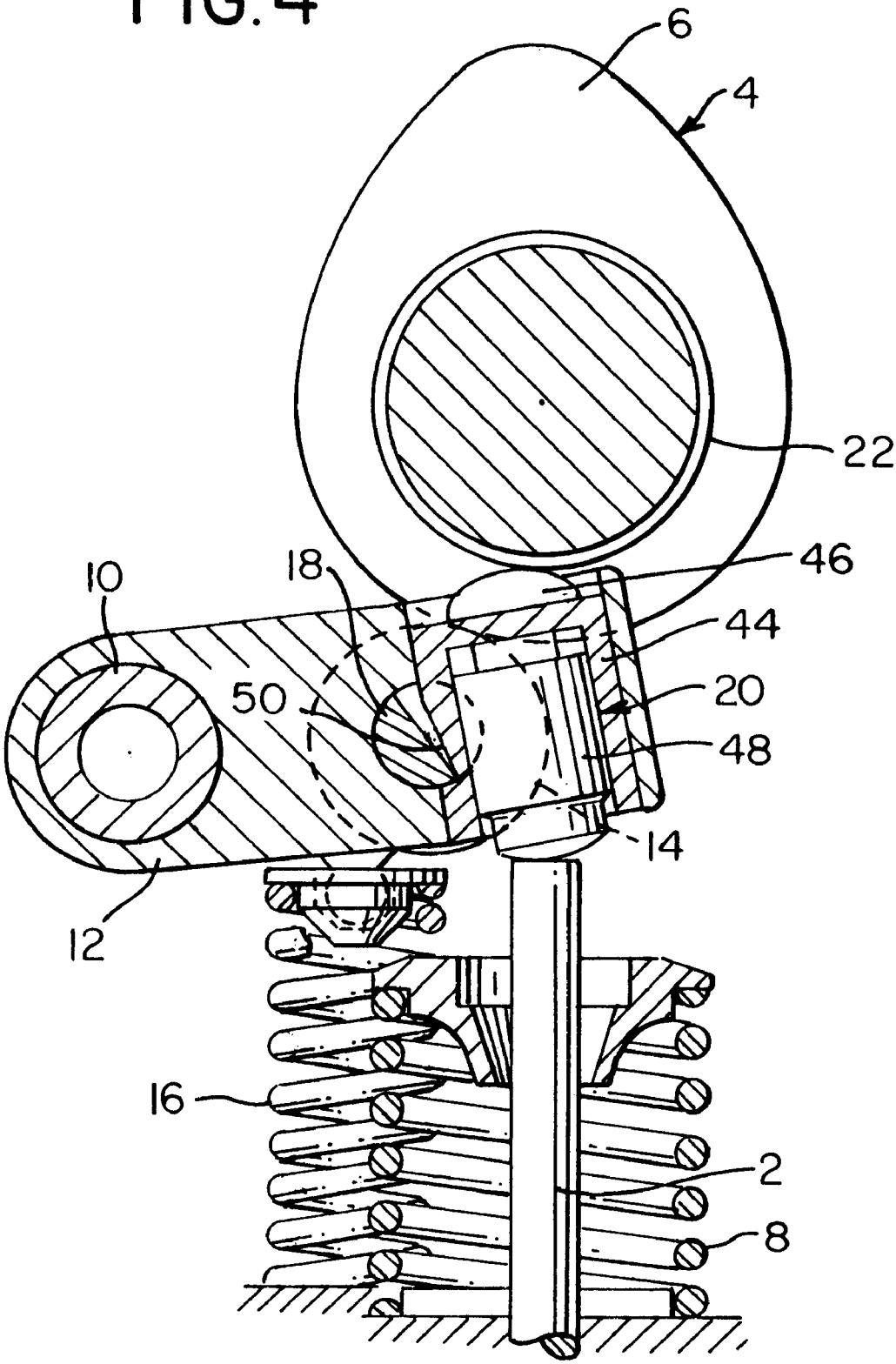
FIG. 4 shows a sectional view of the apparatus according to FIG. 3, shown in the plane IV—IV.

FIG. 4 shows a section of the arrangement according to FIG. 3 in the plane IV—IV. The actuator 20 is comprised of a plurality of parts and has a sleeve 44 which is moveably guided in a throughbore of the pivot level 12. The sleeve 44 is closed at its upper end and receives a valve compensation element. The valve compensation element is embodied with a mushroom-shaped spherical head 46 received in the end face of the sleeve 44. A tappet 48 is guided within the sleeve 44 and ends in the downward direction with a spherical portion that rests at the shaft of the valve 2. The sleeve 44 has a cutout 50 facing the coupling shaft 18. In the shown representation, the coupling shaft 18 with a semi-circular cross-section engages the cutout 50. The represented position of the coupling shaft 18 is the coupling position in which the actuator 20 is rigidly connected to the pivot lever 12 with respect to the pivot movement of the pivot lever 12 caused by the cam disc 6 so that the valve 2 can be actuated. When the coupling shaft 18 is rotated in the clockwise direction to such an extent that its cross section is completely outside of the sleeve 44, the actuator 20 can move relative to the pivot lever 12 so that a pivoting action of the pivot lever 12 without influencing the valve position is possible and the valve remains closed.

The function of the afore described arrangement is as follows.

The solenoid 32 is initially not excited.

When the camshaft, starting in a position according to FIG. 1, is rotated in the clockwise direction, the pivot lever 12 remains in the shown position in which the valve 2 is closed. With the valve being closed, respectively, the pivot lever 12 not being pivoted, the coupling lever 26 is then pivoted by the cam projection of the coupling cam 24 in the clockwise direction so that the cross section of the coupling shaft 18 will be released from the cutout 50 and quickly returned so that the engagement between coupling shaft 18 and sleeve 44, are respectively, actuator 20 is again established. Subsequently, with the actuator 20 and the pivot lever 12 being coupled to one another, the pivot lever 12 is then pivoted by the cam projection of the cam disc 6 in the clockwise direction so that the valve 2 is opened and subsequently closed.

When the solenoid 32 is excited and the pivot lever 26 for the closed valve is pivoted by the coupling cam 24 in the clockwise direction, the portion 28 will be positioned so closely to the pole surfaces 38 that the portion 28 is attracted and the coupling lever 26 is secured in this position in which no engagement between the coupling shaft 18, fixedly connected to the coupling lever 26, and the actuator 20 is provided. The valve 2 is thus switched off. When in this position at any point in time the solenoid 32 is no longer excited (this is effected by a non-represented control device), the portion 28 is released and the coupling lever 26 is forced by the torsion spring 42 in the counter clockwise direction. The coupling shaft 18 rotates into the cutout 50 so that the pivot lever 12 relative to the actuator 20 can be moved upwardly by a sufficient amount under the effect of the return spring 16, and coupling between the coupling shaft 18 and the pivot lever 12 is again established.

The excitation of the solenoid 32, because of energy considerations, advantageously begins only shortly before the portion 28 is in the vicinity of the pole surfaces 38. The excitation of the solenoid is advantageously stopped at the point in time in which the maximum cam projection of the coupling cam 24 faces the coupling lever 26 so that the released coupling lever 26 is received by the coupling cam 24.

The disclosed function is very reliable because the control of the solenoid 32 must not comply with precise specifications and there is no risk of malfunction or mechanical overload.

The disclosed embodiment is designed such that the valve 2 cannot be actuated when the coupling lever 26 is secured by the solenoid 32. When the engagement between the coupling shaft 18 and the actuator 20 is constructed such that it is not established in the position shown in FIG. 1 and is instead established when the coupling shaft 18 is pivoted to the right, respectively, when the coupling lever 26 is secured, the valve 2 is not actuated when the solenoid 32 is not actuated and is actuated when the solenoid 32 is actuated. The functional steps are anagalous to the ones disclosed above.

Figure 5:
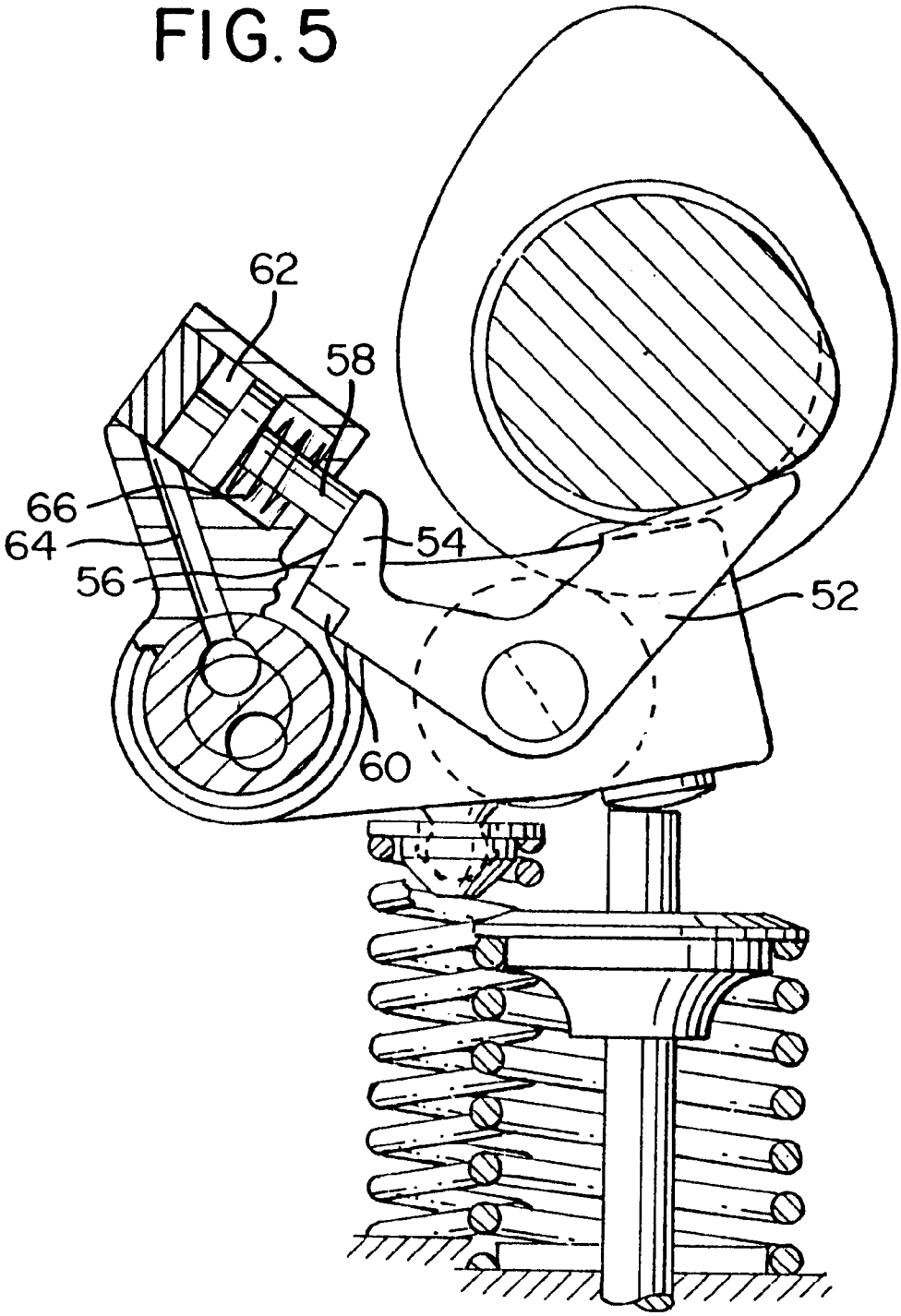
FIG. 5 shows a view similar to FIG. 1 of another embodiment of the inventive apparatus.

FIG. 5 shows an embodiment for securing the coupling lever differing from that of FIG. 1 in that the catch device is not embodied as a solenoid. In order to simply the drawings, only those components of the apparatus that are not identical to those of FIG. 1 are identified by reference numerals.

The left arm of the coupling lever 52 ends in a shoe-shaped portion 54 whereby the sole 56 of the shoe provides an abutment surface for a tappet 58 and is provided at its rearward end with a cutout 60. The tappet 58 is guided at the engine housing within a cylinder whereby the tappet 58 is the piston for this cylinder. The cylinder chamber 62 can be loaded by a hydraulic medium via a hydraulic line 64. For returning the tappet 58 into the cylinder chamber 62 when no hydraulic pressure is present, a spring 66 is provided. The dimensions are selected to provide a pivot range of the coupling lever 52 such that the sole 56 glides past the tappet 58 and, in the position of the coupling lever 52 in which it is pivoted completely in the clockwise direction, the tappet 58 is positioned in the area of the cutout 60.

The function of the arrangement according to FIG. 5 corresponds to that disclosed with respect to FIGS. 1 through 4.

When the cylinder chamber 62 is not loaded with hydraulic pressure, the cutout 60 is within the area of the tappet 58 without the coupling lever 52 being secured. When the cylinder chamber 62 is loaded with pressure, the tappet 58 is prestressed into abutment at the sole 56 so that the tappet 58, as soon as it has crossed the cutout 60, moves into the cutout 60 and secures the coupling lever 52 in its end position in the clockwise direction, which is in this case the decoupling position of the coupling shaft 18.

Figure 6:
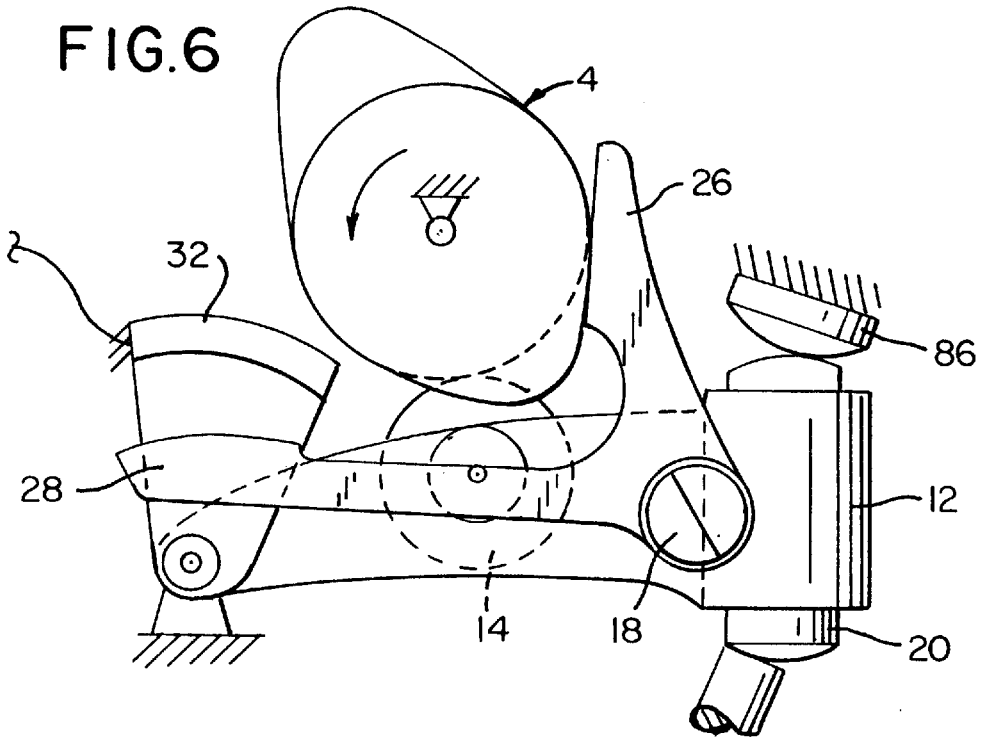
FIGS. 6–11 show end views of further embodiment of the inventive apparatus.

FIG. 6 shows an embodiment which is changed relative to FIG. 1 with regard to its kinematics. The camshaft 4 is not positioned to the right of the roller 14 positioned at the pivot lever 12 but instead above or to the left of it. Accordingly, the angle between the two arms of the coupling lever 26 is smaller relative to the embodiment of FIG. 1. Furthermore, the roller 14 is not coaxially positioned with the coupling shaft 18 but has its own support at the pivot lever 12. For securing the portion 28 of the coupling lever 26 a solenoid 32 is provided. A further difference relative to the above disclosed embodiments is that the actuator 20 is supported at an abutment 86 connected to the engine.

Figure 7:
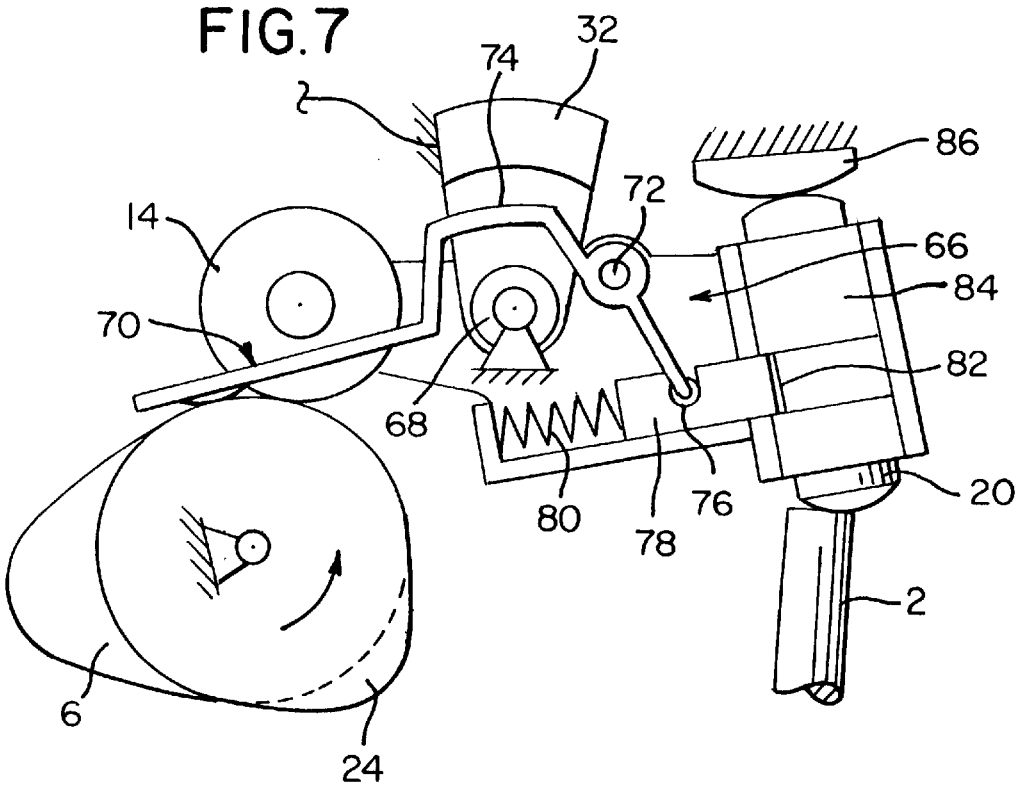

In the embodiment according to FIG. 7, the pivot lever 66 is a rocker arm. It is connected with its central portion (reference numeral 68) to the engine housing and its left end supports the roller 14 for following or sensing the cam disk 6. The coupling lever 70 is supported at 72 at the pivot lever 66 and comprises between its support location 72 and its free end, resting at and following the coupling cam 24, a portion 74 which comes into contact with the solenoid 32 when the pivot lever 66 is pivoted in the clockwise direction. The other free end of the coupling lever 70 engages a cutout 76 of a tappet 78 which, under load of a spring 80, is linearly guided within the pivot lever 66. Upon complete pivoting action of the coupling lever 70 in the clockwise direction, the tappet 78 disengages the cutout 82. This cutout 82 is provided within the actuator 84 that is slidably guided within the pivot lever 66. The function of the apparatus of FIG. 7 corresponds to that of FIG. 1.

In the following description of further embodiments functionally similar components have the same reference numerals as those of FIG. 1.

Figure 8:
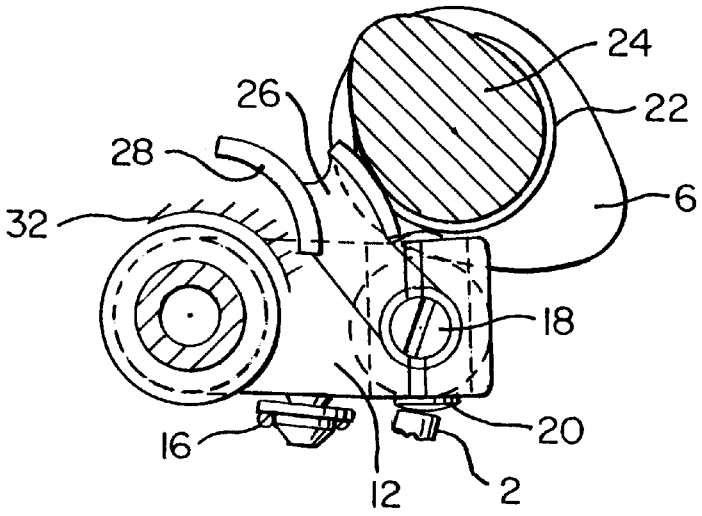

In the embodiment according to FIG. 8 the coupling lever 26 is a single arm lever. Its end portion 28 reaches into the catch area of the solenoid 32 which is arranged at a side of the coupling lever 26 facing the bearing axle of the pivot lever 12.

Figure 9:
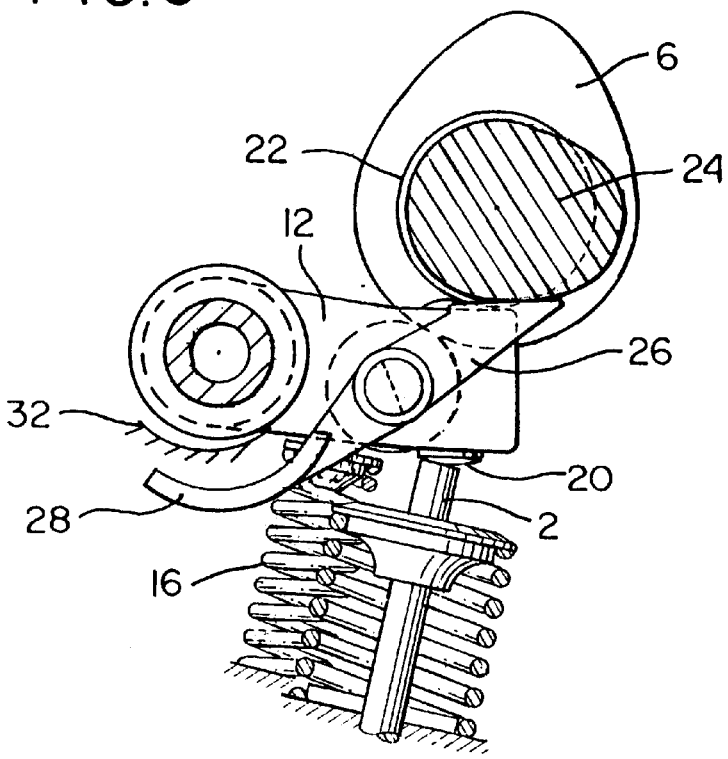

In the embodiment according to FIG. 9 the coupling lever 26 is of a two-arm construction. Its portion 28 reaches into the catch area of the solenoid 32. As disclosed in connection with the embodiment of FIG. 8, the solenoid 32 is arranged on a side of the coupling lever 26 facing the bearing axle of the pivot lever 12.

The actuator 20, in the embodiment according to FIGS. 8 and 9, is supported for the closed valve, respectively, switched off valve at the cylinder surface 22 of the camshaft.

Figure 10:
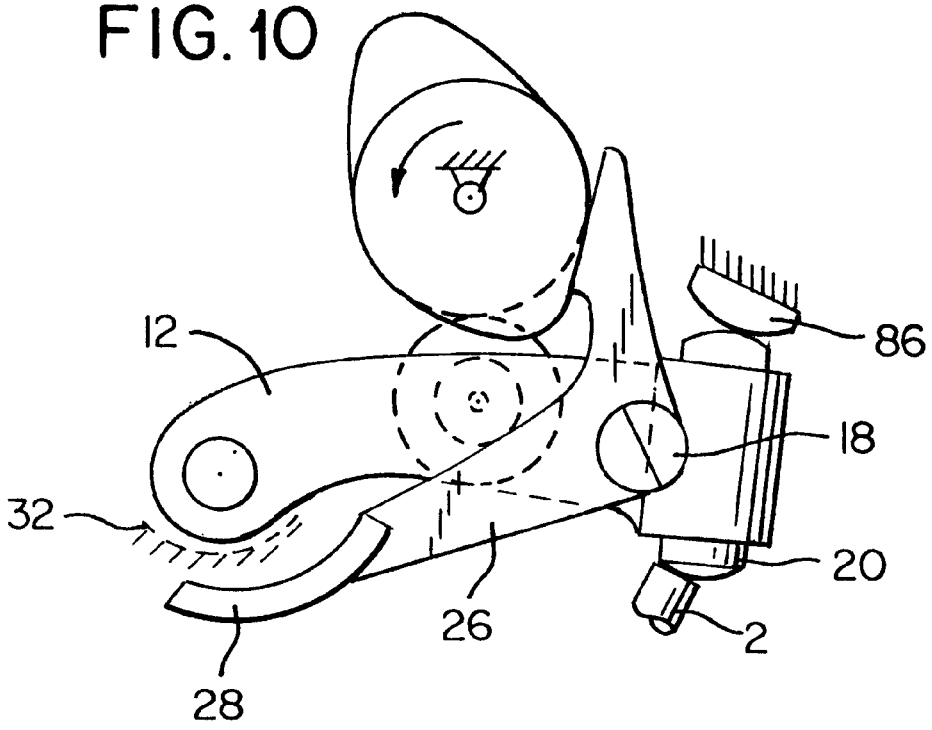

In the embodiment according to FIG. 10, the pivot lever 12 is a slidig lever. The coupling lever 26 is of a two-arm construction. Its portion 28 can reach the catch area of the solenoid 32 facing the support of the pivot lever 12.

Figure 11:
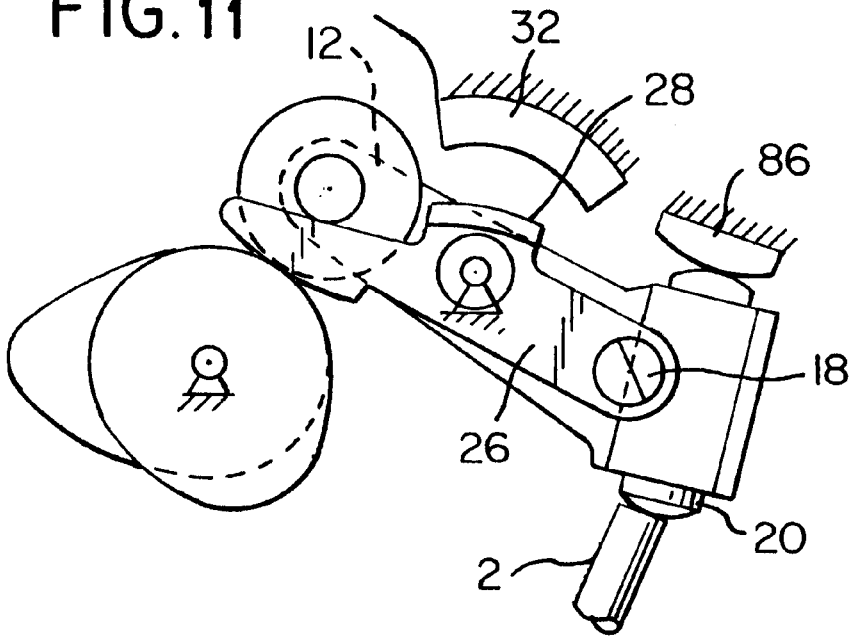

In the embodiment according to FIG. 11, the pivot lever 12 is a rocker arm that supports the single-arm coupling lever 26 having a portion 28 positioned in the catch area of the solenoid 32 that is located remote from the support of the pivot lever 12.

Since the coupling lever 26 secured by the solenoid 32 will follow the pivot movements of the pivot lever 12 caused by the rotation of the cam disk 6, it is advantageous to support the solenoid 32 coaxially to the pivot lever 12 whereby the bushing 10 (FIG. 1) is a bearing bushing.

In the embodiments according to FIGS. 10 and 11, the actuator 20 is supported in the decoupled state between the valve 2 and an abutment 86 connected to the engine.

The specification incorporates by reference the disclosure of German priority document 197 49 124.3 of Nov. 6, 1997.

The present invention is, of course, in no way restricted to the specific disclosure of the specification and drawings, but also encompasses any modifications within the scope of the appended claims.

What is claimed is:

1. An apparatus for switching off a load change valve (2) of an internal combustion engine, said device comprising:

a camshaft (4) having at least one cam disk (6);

a pivot lever (12, 66) pivotably connected to an engine part and pivoted back and forth by said at least one cam disk (6);

an actuator (20, 84) moveably guided in said pivot lever (12, 66) for actuating the load change valve;

a coupling member (18, 78) moveably guided in said pivot lever (12, 66) into one of two end positions, defining a coupling position and a decoupling position, respectively;

wherein in said coupling position said coupling member (18, 78) rigidly connects said actuator (20, 84) and said pivot lever (12, 66);

wherein in said decoupling position said coupling member (18, 78) releases said actuator (20, 84) so that said actuator (20, 84) moves relative to said pivot lever (12, 66) to switch off the load change valve;

a device (24, 26, 52, 70) for moving said coupling member (18, 78) into said coupling position and into said decoupling position;

said device (24, 26, 52, 70) having a coupling cam (24) rotating at a same speed as said at least one cam disk (6) and having a cam projection;

said device (24, 26, 52, 70) further having a coupling lever (26, 52, 70) acting on said coupling member (18, 78);

said coupling cam (24) acting on said coupling lever (26, 52, 70) such that said cam projection moves said coupling member (18, 78) from one of said end positions into the other of said end positions and back into said one end position when said pivot lever (12, 66) follows a base contour of said cam disk (6);

an activatable catch device (32, 58) arranged such that, when said catch device (32, 58) is activated, a securing portion (28, 54, 74) of said coupling lever (26, 52, 70) upon actuation by said coupling cam (24) is secured by said catch device (32, 58) so that said coupling member (18, 78) remains in said other end position independent of a movement of said coupling cam (24).

2. An apparatus according to claim 1, wherein said catch device (32, 58) includes a solenoid (32) having a catch area, wherein said securing portion (28, 54, 74) of said coupling lever (26) is moved by said cam projection of said coupling cam (24) into said catch area.

3. An apparatus according to claim 2, wherein said solenoid (32) is U-shaped and has two legs (36) with pole surfaces (38) and wherein said securing portion (28) of said coupling lever (26) is moved by said coupling cam (24) into close vicinity of said pole surfaces (38).

4. An apparatus according to claim 1, wherein said catch device comprises a moveable lock component (58) and wherein, when said catch device (58) is activated, said lock component (58) is moved into a position in which it engages said securing portion (54) of said coupling lever (52).

5. An apparatus according to claim 1, wherein said catch device is fastened to an engine part and extends coaxially to said pivot lever (12, 66).

6. An apparatus according to claim 1, wherein said coupling cam (24) is fastened to said cam shaft (4).

7. An apparatus according to claim 1, wherein said coupling member is a coupling shaft (18) supported on said pivot lever (12) and fixedly connected to said coupling lever (26), wherein said actuator (20) has a cutout (50) and wherein said coupling shaft (18) has a cross-section adapted to engage said cutout (50).

8. An apparatus according to claim 7, further comprising a spring (42) biasing said coupling shaft (18) in a rotational direction such that said coupling lever (26) is forced into abutment at said coupling cam (24).

9. An apparatus according to claim 1, wherein said coupling member is a tappet (78) linearly guided in said pivot lever (66), wherein said actuator (84) has a cutout (82) and wherein said coupling shaft (18) is adapted to engage said cutout (82).

10. An apparatus according to claim 1, wherein said coupling lever (26) has a first and a second arm, wherein an end portion of said first arm has a follower surface resting at said coupling arm (24) and an end portion of said second arm is said securing portion (28).

11. An apparatus according to claim 1, wherein said pivot lever (66) is a rocker arm and wherein said coupling lever (70) has a first end supported at said rocker arm (66) and a second end engaging said coupling cam (24), wherein a portion of said coupling lever (70) between said first and second ends is said securing portion (74).

* * * * *